US006203145B1

(12) United States Patent
Jeanmaire et al.

(10) Patent No.: US 6,203,145 B1
(45) Date of Patent: Mar. 20, 2001

(54) CONTINUOUS INK JET SYSTEM HAVING NON-CIRCULAR ORIFICES

(75) Inventors: David L. Jeanmaire, Brockport; David P. Trauernicht; Christopher N. Delametter, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/466,346

(22) Filed: Dec. 17, 1999

(51) Int. Cl.[7] ..... B41J 2/02
(52) U.S. Cl. ..... 347/75
(58) Field of Search ..... 342/75–76, 74, 342/44, 47, 17; 347/73

(56) References Cited

U.S. PATENT DOCUMENTS

| | | | |
|---|---|---|---|
| 1,941,001 | 12/1933 | Hansell | 347/75 |
| 3,878,519 | 4/1975 | Eaton | 347/75 |
| 5,404,159 | 4/1995 | Ohashi | 347/75 |
| 5,714,992 | 2/1998 | Desie | 347/75 |
| 5,966,154 * | 10/1999 | DeBoer | 347/75 |
| 5,984,446 * | 11/1999 | Silverbrook | 347/3 |

FOREIGN PATENT DOCUMENTS 2 041 831 9/1980 (GB) .

* cited by examiner

*Primary Examiner*—N. Le
*Assistant Examiner*—Judy Nguyen

(57) ABSTRACT

A continuous ink jet printing system using asymmetrical heating of the fluid in which the nozzle bore (46, 76, 78) of the printhead preferably has a non-circular opening. The nozzle bore (46, 76, 78) has reflection symmetry about the long axis of its cross-section and may be, for example, elliptical or rectangular. In the preferred embodiment of the invention, the nozzle bore (46, 76, 78) has an aspect ratio greater than unity, wherein the aspect ratio is defined as the ratio of the long axis length to the short axis length. A heater (50, 50', 50") used to generate deflection of the fluid exiting the nozzle bore (46, 76, 78) generally conforms to the perimeter of the nozzle bore (46, 76, 78) such that the heated portion is along the long dimension of the nozzle bore (46, 76, 78).

30 Claims, 5 Drawing Sheets

CONTINUOUS INK JET SYSTEM HAVING NON-CIRCULAR ORIFICES

CROSS REFERENCE TO RELATED APPLICATIONS

Reference is made to commonly assigned, co-pending U.S. patent application Ser. No. 08/954,317, now U.S. Pat. No. 6,079,821, entitled CONTINUOUS INK JET PRINTER WITH ASYMMETRIC HEATING DROP DEFLECTION filed in the names of Chwalek, Jeanmaire, and Anagnostopoulos on Oct. 17, 1997.

FIELD OF THE INVENTION

This invention relates generally to the field of digitally controlled printing devices, and in particular to continuous ink jet print heads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high-quality color images at a high speed and low cost, using standard paper.

Ink jet printing has become recognized as a prominent contender in the digitally controlled, electronic printing arena because of, e.g., its non-impact, low-noise characteristics, its use of plain paper and its avoidance of toner transfers and fixing. Ink jet printing mechanisms can be categorized as either continuous ink jet or drop-on-demand ink jet. Continuous ink jet printing dates back to at least 1929. See U.S. Pat. No. 1,941,001 to Hansell.

Conventional continuous ink jet printing utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. U.S. Pat. No. 3,878,519, which issued to Eaton in 1974, discloses a method and apparatus for synchronizing droplet formation in a liquid stream using electrostatic deflection by a charging tunnel and deflection plates.

U.K. Patent Application GB 2 041 831A discloses a mechanism in which a deflector steers an ink jet by the Coanda (wall attachment) effect. The degree of deflection can be varied by moving the position of the deflector or by changing the amplitude of perturbations in the jet.

In commonly assigned, co-pending U.S. patent application Ser. No. 08/954,317, now U.S. Pat. No. 6,079,821, entitled CONTINUOUS INK JET PRINTER WITH ASYMMETRIC HEATING DROP DEFLECTION, filed in the names of Chwalek, Jeanmaire, and Anagnostopoulos on Oct. 17, 1997, an ink jet printer includes a delivery channel for pressurized ink to establish a continuous flow of ink in a stream flowing from a nozzle bore. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction.

It was also disclosed in the above-cited co-pending application that, using semiconductor VLSI fabrication processes and equipment, and by incorporating addressing and driving circuits on the same silicon substrate as the nozzles, a dense linear array of nozzles can be produced. Such arrays can be many inches long and contain thousands of nozzles, thus eliminating the need to scan the print head across the page. In addition, inkjet printers may contain multiple arrays, all of which may be located on the same silicon substrate. Each array could then emit a different color ink. Full-width and full-color ink jet printers can thus be manufactured, which can print at high speeds and produce high-quality color prints.

SUMMARY OF THE INVENTION

In graphic arts printing systems it is required that the droplets land extremely accurately on the specified locations, because of the high-quality images expected from such systems. Many factors influence drop placement, such as air turbulence or non-uniform air currents between the print head and the receiver, varying resistance of the heaters or other manufacturing defects that affect droplet deflection. Such systems may include elimination of turbulence and more uniform air currents, higher-velocity drops, more uniform heater resistance, etc.

Accordingly, it is a feature of the present invention to provide an apparatus for controlling ink in a continuous ink jet printer including an ink delivery channel; a nozzle bore which opens into the ink delivery channel to establish a continuous flow of ink in a stream; a heater having a plurality of selectively independently actuated sections which arc positioned along respectively different portions of the nozzle bore's perimeter. An actuator selectively activates none, one, or a plurality of the heater sections such that actuation of heater sections associated with only a portion of the entire nozzle bore perimeter produces an asymmetric application of heat to the stream to control the direction of the stream between a print direction and a non-print direction. Simultaneous actuation of different numbers of heater sections associated with only a portion of the entire nozzle bore perimeter produces a corresponding different asymmetric application of heat to the stream to thereby control the direction of the stream between one print direction and another print direction.

The nozzle bore preferably has an opening with an aspect ratio greater than unity. The aspect ratio is a ratio of the long axis to the short axis of the nozzle bore. Any non-circular nozzle bore is contemplated, however, it is preferred that reflection symmetry exists about the nozzle bore's long axis. It is also contemplated that reflection symmetry may exist about the nozzle bore's short axis in conjunction with reflection symmetry about the nozzle bore's long axis.

It is another feature of the present invention to provide a print head that has a single actuated section which is positioned along the perimeter of the nozzle bore such that a gap is defined along a portion of the nozzle bore's perimeter. Actuation of the heater section causes fluid stream deflection towards the gap.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Referring more specifically to the drawings, for illustrative purposes the present invention is embodied in the apparatus generally shown in FIG. 1 through FIG. 7. It will be appreciated that the apparatus may vary as to configuration and as to details of the parts without departing from the basic concepts as disclosed herein.

Figure 1:
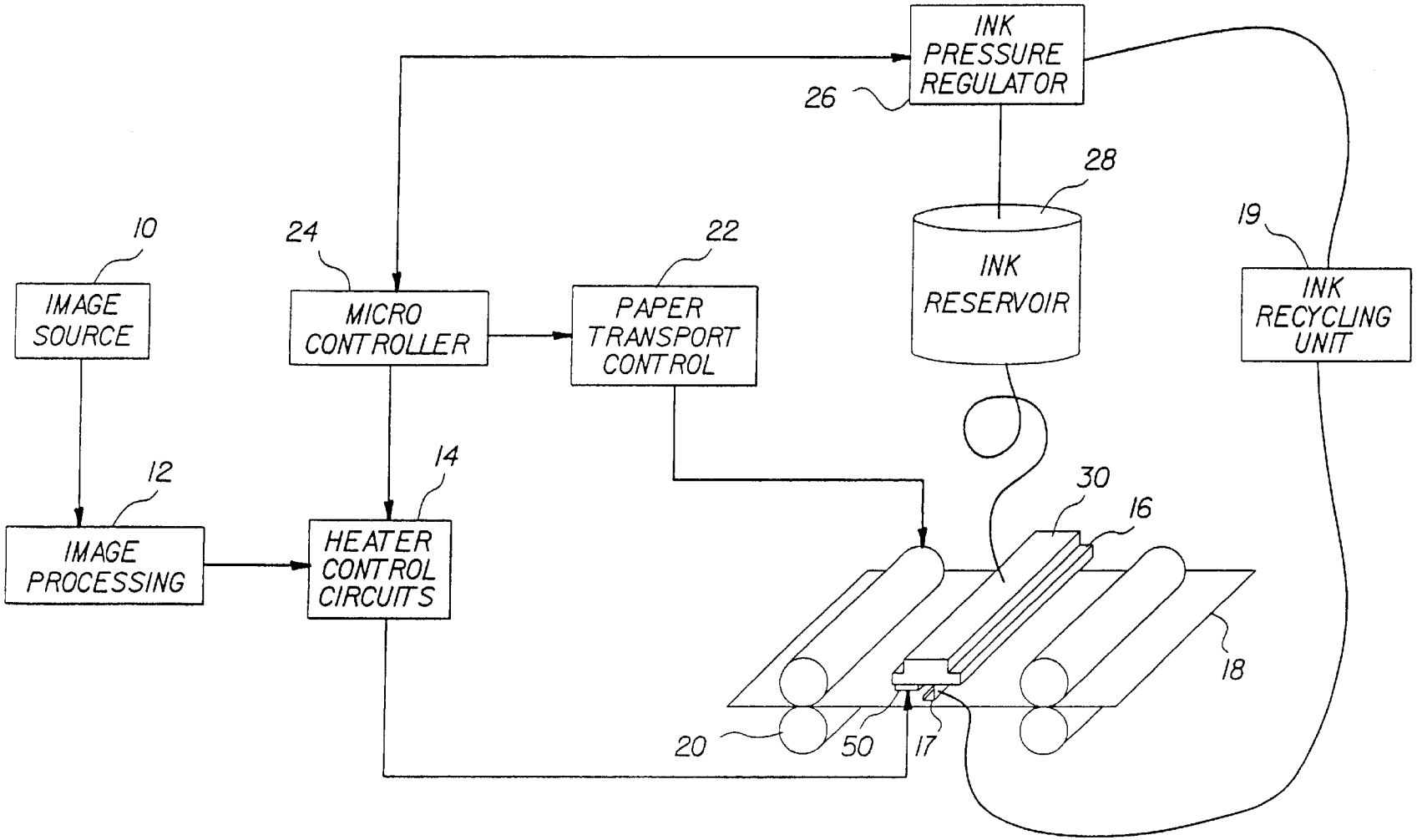
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to multi-level, half-toned bitmap image data by an image processing unit 12 which also stores the image data in memory. A plurality of heater control circuits 14 read data from the image memory and apply time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page-width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles and heaters 50 are situated. With print head 16 fabricated from silicon, it is possible to integrate heater control circuits 14 with print head 16.

Figure 2:
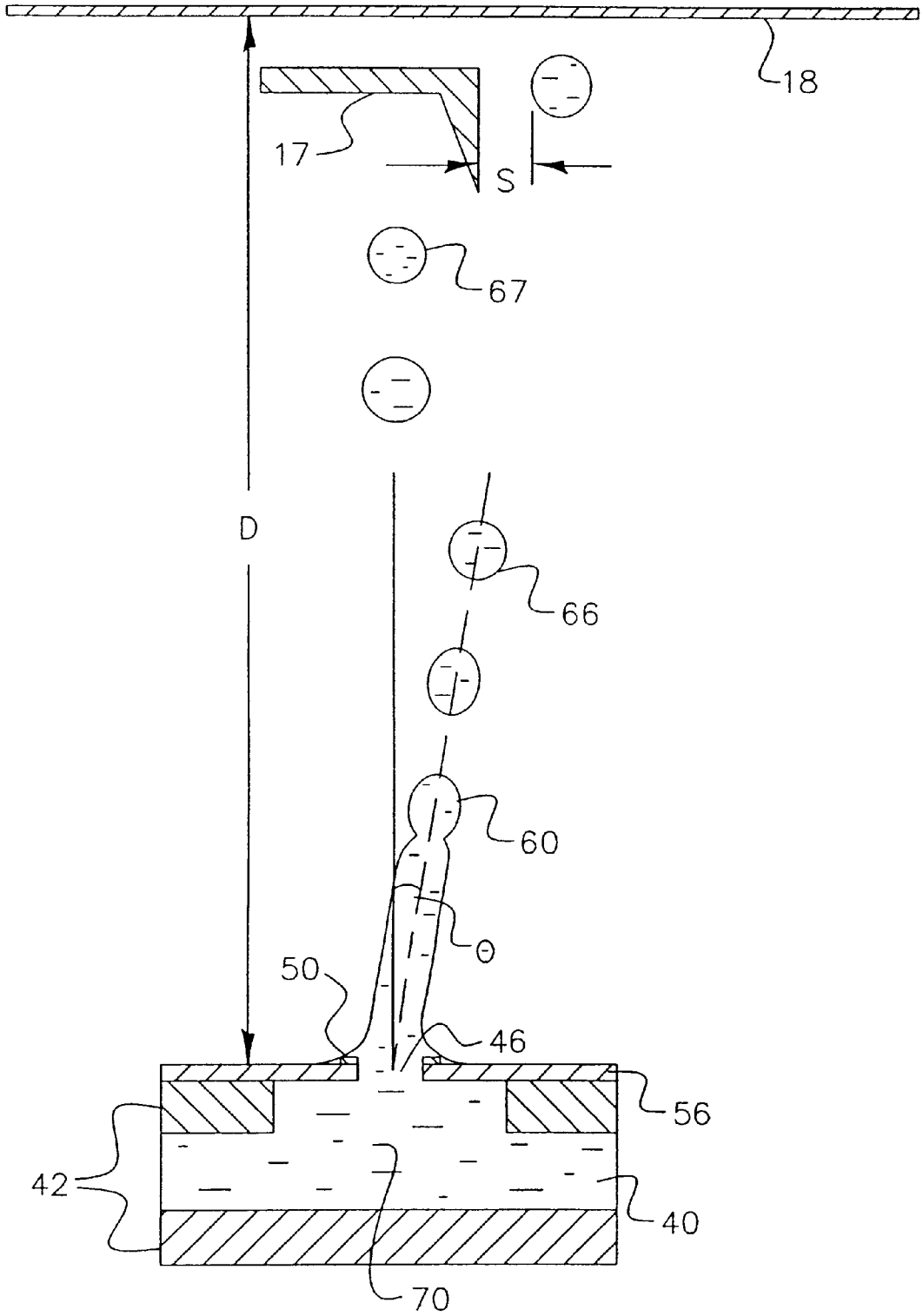
FIG. 2 shows a cross-section of a nozzle bore with asymmetric heating deflection.

Referring also to FIG. 2, a cross-sectional view of one nozzle of an array of such nozzles that form continuous ink jet print head 16 of FIG. 1, according to a preferred embodiment of the preferred invention. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form nozzle bores 46. Ink 70 in delivery channel 40 is pressurized above atmospheric pressure, and forms a stream 60. At a distance above nozzle bore 46, stream 60 breaks into a plurality of drops 66 due to a periodic heat pulse supplied by a heater 50. Heater 50 is separated from substrate 42 by thermal and insulating layers 56 to minimize heat loss to substrate. Nozzle bore 46 may be etched allowing the nozzle exit orifice to be defined by insulating layers 56.

Figure 3:
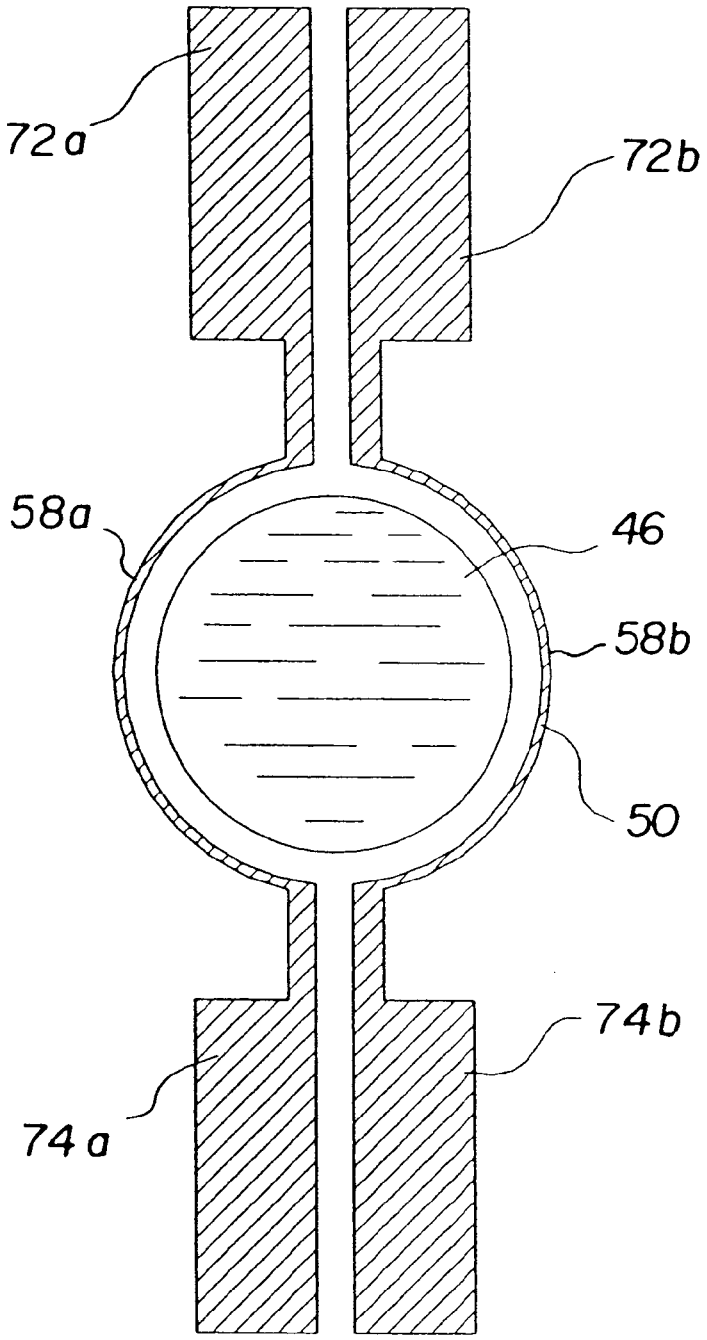
FIG. 3 is a top view of a circular nozzle bore with asymmetric heating deflection, shown with a heater having two opposing sections.

Referring also to FIG. 3, heater 50 has two sections **58*a* and 58*b*, each covering approximately one-half of the perimeter of nozzle bore 46. The power connections 72*a* and 72*b* and the ground connections 74*a* and 74*b* from the drive circuitry to heater 50 are also shown. Stream 60 may be deflected by an asymmetric application of heat by supplying electrical current to one, but not both, of heater sections 58*a* and 58*b*. This technology is distinct from that of prior systems of electrostatic continuous-stream deflection printers, which rely upon deflection of charged drops previously separated from their respective streams. With stream 60 being undeflected, drops 66, shown in FIG. 2, may be blocked from reaching recording medium 18 by a cut-off device such as an ink gutter 17. In an alternate printing scheme, ink gutter 17 may be placed to block deflected drops 66 so that un-deflected drops 67 will be allowed to reach recording medium 18**.

In either printing scheme, an important system parameter is the angle at which the ink fluid deflects. This angle, denoted by θ, is shown in FIG. 2. It is the angle formed between a line connecting the deflected drops to the center of nozzle bore 46 on the surface of electrical insulating layers 56 and a line normal to the electrical insulating layers 56 centered at nozzle bore 46. Greater drop deflection results in a more robust system. The larger the deflection angle θ, the closer ink gutter 17 may be placed relative to printhead 16, and hence, printhead 16 can be placed closer to recording medium 18. This distance D is shown in FIG. 2. In general, shorter drop travel distance D will result in lower drop placement errors, which will result in higher image quality. Also, for a particular ink gutter 17 to printhead 16 distance, larger deflection angles θ result in larger deflected drop 66 to ink gutter 17 spacing, shown as S in FIG. 2. A larger deflected drop 66 to ink gutter 17 spacing would allow a larger ink gutter 17 to printhead 16 alignment tolerance. Larger deflection angles θ also allow for larger amounts of (unintended) undeflected drop 67 misdirection. Undeflected drop misdirection may occur, for instance, due to fabrication non-uniformity from nozzle to nozzle or due to dirt, debris, deposits, or the like, that may form in or around nozzle bore 46.

Figure 4:
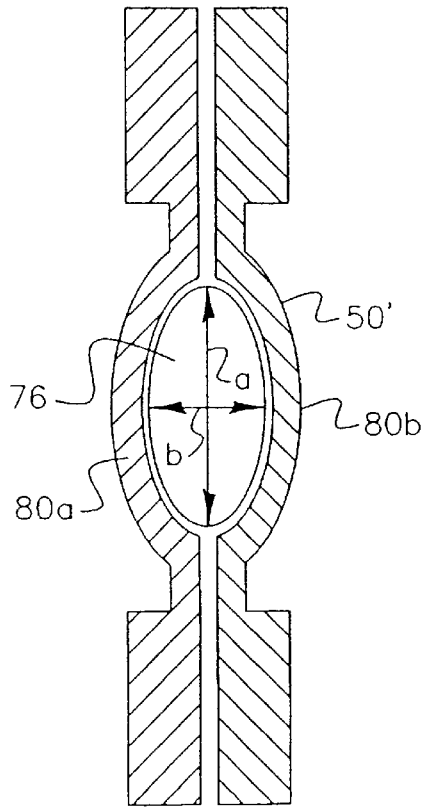
FIG. 4 is a top view of an elliptical nozzle bore with asymmetric heating deflection, shown with a heater having two opposing sections.
Figure 5:
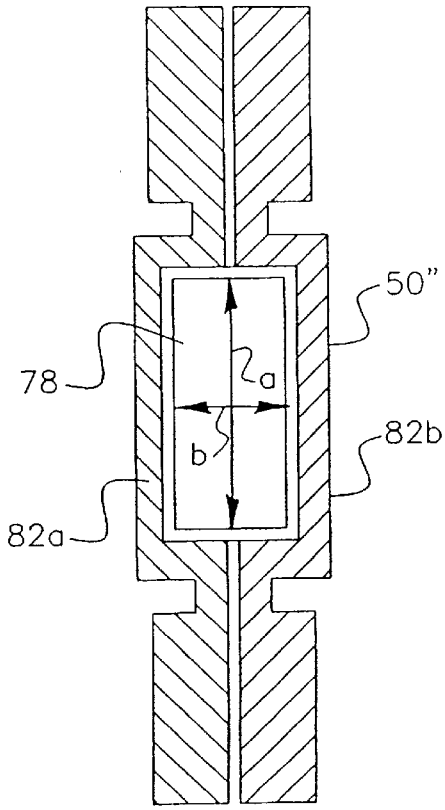
FIG. 5 is a top view of a rectangular nozzle bore with asymmetric heating deflection, shown with a heater having two opposing sections.

Referring also to FIG. 4 and FIG. 5, preferred embodiments of nozzle bore 76 and 78, in accordance with the present invention, are generally shown. Nozzle bore 76 and 78 may be of any non-circular shape, however, it is preferred that reflection symmetry exists about its long axis, depicted by "a". It is also contemplated that reflection symmetry may exist about the nozzle bore's short axis, depicted by "b", in conjunction with reflection symmetry about the nozzle bore's long axis. Non-circular orifices yield improved deflection angles θ for fluid stream 60 exiting therefrom. Nozzle bore 76 and 78 has an opening with an aspect ratio greater than 1.0, and preferably, an aspect ratio greater than or equal to approximately 2.0. Hence, the opening of nozzle bore 76 and 78 may be mathematically described generally by the equation: $a/b>1.0$, however a preferred embodiment of nozzle bore 76 and 78 may be mathematically described generally by the equation: $a/b \geqq 2.0$. The aspect ratio is defined as the ratio of the length of the long axis, "a", to the length of the short axis, "b". For example, nozzle bore 76 may be elliptical, as shown in FIG. 4, or nozzle bore 78 may be rectangular, as shown in FIG. 5.

Heater 50' has sections 80*a* and 80*b*, each conforming to approximately one-half of the perimeter of nozzle bore 76 along its long axis "a", about which reflection symmetry lies. Similarly, heater 50" has sections 82*a* and 82*b*, each conforming to approximately one-half of the perimeter of nozzle bore 78 along its long axis "a", about which reflection symmetry lies. Experiments have shown that the figure of merit for fluid stream deflection in elliptical nozzle bore 76, where $a/b=2$, is approximately 1.9 times greater than that of nozzle bore 46 having a generally circular cross-section. Experiments have shown that the figure of merit for fluid stream deflection in rectangular nozzle bore 78, where $a/b=2$, is approximately 3.5 times greater than that of nozzle bore 46 having a generally circular cross-section. Accordingly, it can be seen that nozzle bores having aspect ratios greater than unity provide for greater drop deflection, and thus, contribute to a more robust printing system.

Figure 6:
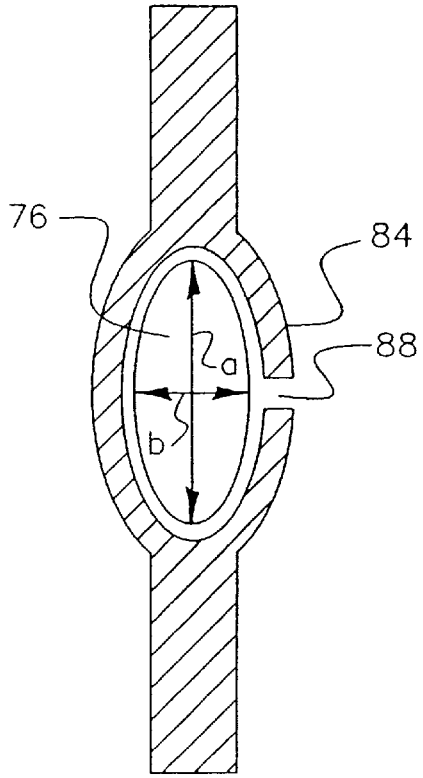
FIG. 6 is a top view of an elliptical nozzle bore with asymmetric heating deflection, shown with a heater having a single section.
Figure 7:
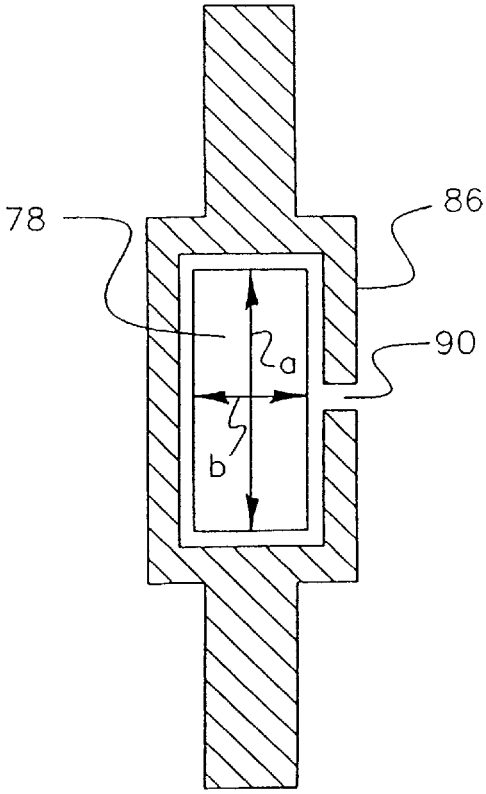
FIG. 7 is a top view of a rectangular nozzle bore with asymmetric heating deflection, shown with a heater having a single section.

Referring to FIG. 6 and FIG. 7, an alternate embodiment of heater 84 and 86, in accordance with the present invention, is generally shown. Heater 84 is shown in FIG. 6 in conjunction with elliptical bore 76, and heater 86 is shown in FIG. 7 in conjunction with rectangular bore 78. Heater 84 and 86 has a single section that conforms to a majority of the perimeter of nozzle bore 76 and 78, respectively. The section of heater 84 and 86 is non-continuous around the perimeter of nozzle bore 76 and 78, respectively, wherein heater 84 and 86 incorporates a single gap 88 and 90, respectively, defined within the heater section. Gap 88 and 90 is disposed adjacent one side of nozzle bore 76 and 78, respectively, along the long axis "a". When electrical current is supplied to heater 84 and 86, the fluid stream exiting from nozzle bore 76 and 78 deflects toward gap 88 and 90, respectively.

Although the description above contains many specificities, these should not be construed as limiting the scope of the invention, but merely as providing illustrations of some of the presently preferred embodiments of this invention. Thus, the scope of this invention should be determined by the appended claims and their legal equivalents.

PARTS LIST

10 image source
12 image processing unit
14 heater control circuits
16 print head
17 ink gutter
18 recording medium
19 ink recycling unit
20 recording medium transport system
22 recording medium transport control system
24 micro-controller
26 ink pressure regulator
28 ink reservoir
30 channel device
40 ink delivery channel
42 substrate
46 nozzle bore
50 heater (circular bore)
50' heater (elliptical bore)
50" heater (rectangular bore)
56 insulating layers
58*a/b* heater sections (circular bore)
60 fluid stream
66 deflected drop
67 undeflected drop
70 ink fluid
72*a/b* power connections
74*a/b* ground connections
76 nozzle bore (elliptical)
78 nozzle bore (rectangular)
80*a/b* sections of heater (elliptical bore)
82*a/b* sections of heater (rectangular bore)
84 heater—alternate embodiment (elliptical bore)
86 heater—alternate embodiment (rectangular bore)
88 heater gap (elliptical bore)
90 heater gap (rectangular bore)

What is claimed is:

1. A continuous fluid-directing apparatus, comprising:

(a) a non-circular orifice for discharging a fluid stream therethrough, said orifice having a long axial dimension and a short axial dimension, both of said axial dimensions being generally positioned in a plane substantially perpendicular to said fluid stream wherein a ratio of said long axial dimension to said short axial dimension is greater than unity; and (b) an asymmetrical heater, said heater conforming to said orifice such that heating occurs along said long axial dimension of said orifice.

2. An apparatus as recited in claim 1, wherein a first portion of said orifice is substantially symmetrical relative to a second portion of said orifice as viewed about said long axial dimension of said orifice.

3. An apparatus as recited in claim 2, wherein a third portion of said orifice is substantially symmetrical relative to a fourth portion of said orifice as viewed about said short axial dimension of said orifice.

4. An apparatus as recited in claim 1, wherein a ratio of said long axial dimension to said short axial dimension is approximately greater than or equal to 2.

5. An apparatus as recited in claim 1, wherein said asymmetrical heater comprises two sections, each said section covering approximately one-half of the perimeter of said orifice along its long axial dimension.

6. An apparatus as recited in claim 1, wherein said asymmetrical heater comprises:

(a) a single section disposed along a majority of the perimeter of said orifice; and (b) a gap interrupting said single section, said gap disposed adjacent one side of said orifice along said long axial dimension.

7. An apparatus as recited in claim 1, wherein said orifice is elliptically shaped.

8. An apparatus as recited in claim 1, wherein said orifice is rectangularly shaped.

9. A continuous fluid-directing apparatus, comprising:

(a) a nozzle bore, said nozzle bore adapted to discharge a stream of fluid therethrough, said nozzle bore having an opening, said opening having a long axial dimension and a short axial dimension, a ratio of said long axial dimension to said short axial dimension being greater than unity, both of said axial dimensions being generally positioned in a plane substantially perpendicular to said stream of fluid; and (b) a heater for asymmetrically deflecting the fluid stream discharged from said nozzle bore, said heater disposed generally about the perimeter of said nozzle bore.

10. An apparatus as recited in claim 9, wherein a first portion of said opening is substantially symmetrical relative to a second portion of said opening as viewed about said long axial dimension of said opening.

11. An apparatus as recited in claim 10, wherein a third portion of said opening is substantially symmetrical relative to a fourth portion of said opening as viewed about said short axial dimension of said opening.

12. An apparatus as recited in claim 9, wherein a ratio of the long axial dimension to the short axial dimension is approximately greater than or equal to 2.

13. An apparatus as recited in claim 9, wherein said heater comprises two sections, each said section covering approximately one-half of the perimeter of said nozzle bore along its long axial dimension, each said section capable of independent activation relative to the other.

14. An apparatus as recited in claim 9, wherein said heater comprises:

(a) a single continuous section disposed along the perimeter of said nozzle bore, said section activated by application of an electrical pulse; and (b) a gap defined within said single continuous section, said gap disposed adjacent one side of said orifice along said long axial dimension;

(c) wherein application of an electrical pulse to said section deflects a fluid stream towards said gap.

15. An apparatus as recited in claim 9, wherein said nozzle bore has an elliptical cross-section.

16. An apparatus as recited in claim 9, wherein said nozzle bore has a rectangular cross-section.

17. A continuous fluid-directing apparatus, comprising:

(a) a nozzle bore, said nozzle bore adapted to discharge a stream of fluid therethrough, said nozzle bore having an opening, said opening having a long axial dimension and a short axial dimension, a ratio of said long axial dimension to said short axial dimension being greater than unity, both of said axial dimensions being generally positioned in a plane substantially perpendicular to said stream of fluid; and (b) a heater disposed around said nozzle bore, said heater including two sections capable of independent activation by an electrical pulse, wherein each said section is disposed approximately one-half of the perimeter of said nozzle bore along its long axial dimension.

18. An apparatus as recited in claim 17, wherein a first portion of said opening is substantially symmetrical relative to a second portion of said opening as viewed about said long axial dimension of said opening.

19. An apparatus as recited in claim 18, wherein a third portion of said opening is substantially symmetrical relative to a fourth portion of said opening as viewed about said short axial dimension of said opening.

20. An apparatus as recited in claim 17, wherein a ratio of the long axial dimension to the short axial dimension is approximately greater than or equal to 2.

21. An apparatus as recited in claim 17, wherein said nozzle bore has an elliptical opening.

22. An apparatus as recited in claim 17, wherein said nozzle bore has a rectangular opening.

23. A continuous fluid-directing apparatus, comprising:

(a) a nozzle bore, said nozzle bore adapted to discharge a stream of fluid therethrough, said nozzle bore having an opening, said opening having a long axial dimension and a short axial dimension, a ratio of said long axial dimension to said short axial dimension being greater than unity, both of said axial dimensions being generally positioned in a plane substantially perpendicular to said stream of fluid;

(b) a single continuous section disposed along the perimeter of said nozzle bore, said section activated by application of an electrical pulse; and (c) a gap defined within said single continuous section, said gap disposed adjacent one side of said orifice along said long axial dimension, wherein application of an electrical pulse to said section deflects a fluid stream towards said gap.

24. An apparatus as recited in claim 23, wherein a first portion of said opening is substantially symmetrical relative to a second portion of said opening as viewed about said long axial dimension of said opening.

25. An apparatus as recited in claim 24, wherein a third portion of said opening is substantially symmetrical relative to a fourth portion of said opening as viewed about said short axial dimension of said opening.

26. An apparatus as recited in claim 23, wherein a ratio of the long axial dimension to the short axial dimension is approximately greater than or equal to 2.

27. An apparatus as recited in claim 23, wherein said nozzle bore has an elliptical opening.

28. An apparatus as recited in claim 23, wherein said nozzle bore has a rectangular opening.

29. An apparatus as recited in claim 23, wherein said single continuous section has a circumference, said gap being less than one half of said circumference.

30. An apparatus as recited in claim 23, wherein said single continuous section has a circumference, said gap being less than one quarter of said circumference.

* * * * *